US012378755B2

(12) United States Patent
Zhang et al.

(10) Patent No.: US 12,378,755 B2
(45) Date of Patent: Aug. 5, 2025

(54) WATER TANK DRAINAGE VOLUME CONTROL STRUCTURE, AND TOILET

(71) Applicant: XIAMEN R&T PLUMBING TECHNOLOGY CO., LTD., Fujian (CN)

(72) Inventors: Rongyu Zhang, Xiamen (CN); Xingdong Wang, Xiamen (CN)

(73) Assignee: XIAMEN R&T PLUMBING TECHNOLOGY CO., LTD., Fujian (CN)

( * ) Notice: Subject to any disclaimer, the term of this patent is extended or adjusted under 35 U.S.C. 154(b) by 142 days.

(21) Appl. No.: 18/266,003

(22) PCT Filed: Jan. 7, 2021

(86) PCT No.: PCT/CN2021/070639
§ 371 (c)(1),
(2) Date: Jun. 8, 2023

(87) PCT Pub. No.: WO2022/121076
PCT Pub. Date: Jun. 16, 2022

(65) Prior Publication Data

US 2024/0093472 A1 Mar. 21, 2024

(30) Foreign Application Priority Data

Dec. 10, 2020 (CN) ..... 202022940569.X

(51) Int. Cl.
*E03D 1/35* (2006.01)
*E03D 1/26* (2006.01)

(52) U.S. Cl.
CPC *E03D 1/35* (2013.01); *E03D 1/26* (2013.01)

(58) Field of Classification Search
CPC .... E03D 1/35; E03D 1/26; E03D 1/14; E03D 1/34; E03D 11/02
See application file for complete search history.

(56) References Cited

FOREIGN PATENT DOCUMENTS

| | | | |
|---|---|---|---|
| CN | 201962768 | U | 9/2011 |
| CN | 208415433 | U | 1/2019 |
| CN | 211523397 | U | 9/2020 |
| CN | 112554290 | A | 3/2021 |
| JP | 5928978 | B2 | 6/2016 |
| WO | 2018164562 | A1 | 9/2018 |

*Primary Examiner* — Christine J Skubinna
(74) *Attorney, Agent, or Firm* — Nitin Kaushik

(57) ABSTRACT

Disclosed is a water tank drainage volume control structure comprising: a water tank body (1), having a first water storage chamber (11) and a second water storage chamber (12), the first water storage chamber (11) being provided with a first drainage channel, and the second water storage chamber (12) being provided with a second drainage channel; a drainage valve (2), used for controlling the opening/closing of the second drainage channel, the drainage valve (2) being provided with a full-drainage switch and a half-drainage switch for controlling the opening of the second drainage channel; and a water blocking member (3), moving with respect to the water tank body (1) under the control of the full-drainage switch or the half-drainage switch so as to control switching of the first drainage channel between open and closed states. The present invention uses a drainage valve to control drainage, can also achieve half drainage and full drainage of a water tank, and is simple in structure and reliable in function.

20 Claims, 9 Drawing Sheets

A

WATER TANK DRAINAGE VOLUME CONTROL STRUCTURE, AND TOILET

BACKGROUND OF THE INVENTION

1. Technical Field

The utility model relates to the technical field of toilets, in particular to a water tank drainage volume control structure and toilet.

2. Description of Related Art

Some toilet water tanks currently available in the market can only use drainage valves featuring single drainage volume for structural reasons, such as a water tank with a negative pressure auxiliary flushing device, so as to ensure that the level of remaining water in the water tank is consistent after drainage, which further ensures that the water level difference between water in the water tank and water in the negative pressure auxiliary flushing device is consistent, so that the negative pressure auxiliary flushing device can have a better effect. In this case, it is best to use a drainage valve featuring single drainage volume to control the drainage of the water tank, so that the water tank can only drain water by a single drainage volume.

BRIEF SUMMARY OF THE INVENTION

As mentioned above, without dual drainage, wastage of water is caused because too much water is used for flushing urine. In view of this, the utility model provides a water tank drainage volume control structure and a toilet.

The purpose of the utility model is to provide a water tank drainage volume control structure and a toilet, in which a single-drainage valve is adopted to control drainage, but can still realize single drainage (half drainage) and dual drainage (full drainage) of the water tank, the structure is simple, and functions are reliable.

The above purpose of the utility model is achieved through the following technical scheme.

A water tank drainage volume control structure comprises:

- a water tank body, having a first water storage chamber and a second water storage chamber, the first water storage chamber being provided with a first drainage channel, and the second water storage chamber being provided with a second drainage channel;
- a drainage valve, used for controlling the opening/closing of the second drainage channel, the drainage valve being provided with a full-drainage switch and a half-drainage switch for controlling the opening of the second drainage channel; and
- a water blocking member, moving with respect to the water tank body under the control of the full-drainage switch or the half-drainage switch so as to control switching of the first drainage channel between open and closed states.

Further, the first drainage channel is a water passage connecting the first water storage chamber with the second water storage chamber, and when the water passage is open, water in the first water storage chamber flows to the second water storage chamber via the water passage; or, water in the first water storage chamber and water in the second water storage chamber (12) flow out of the water tank body independently through the first drainage channel and the second drainage channel respectively, and the second drainage channel is a drainage port formed in a bottom of the second water storage chamber.

Further, the full-drainage switch drives the water blocking member, so that the water blocking member is switched from controlling the water passage to be closed to controlling the water passage to be open, and the half-drainage switch does not drive the water blocking member; or, the half-drainage switch drives the water blocking member, so that the water blocking member is switched from controlling the water passage to be open to controlling the water passage to be closed, and the full-drainage switch does not drive the water blocking member.

Further, the drainage valve comprises a valve core in open-close fit with the drainage port, and a float component in coupling fit or separation fit with the valve core, the valve core is driven to ascend by the full-drainage switch and the half-drainage switch and then is coupled to the float component, and the valve core is linked with the water blocking member so that the water blocking member can control switching of the water passage between open and closed states.

Further, the water tank drainage volume control structure also comprises a limiting member for limiting a position of the water blocking member or releasing the position limitation of the water blocking member; when the full-drainage switch is driven, the full-drainage switch is linked with the limiting member to release the position limitation of the water blocking member, and the water blocking member moves relative to the water tank body and controls the water passage to switch to an open state; or, when the half-drainage switch is driven, the position limitation of the water blocking member is released by the limiting member, and the water blocking member moves relative to the water tank body and controls the water passage to switch to a closed state.

Further, the water blocking member comprises a buoyancy piece, a magnetic piece or an elastic piece; after the position limitation of the water blocking member is released by the limiting member, the water blocking member moves relative to the water tank body under the action of buoyancy, magnetism or elasticity and opens the water passage; and the water blocking member returns to the original position and closes the water passage under the action of its own gravity or under the linkage of the valve core of the drainage valve.

Further, the limiting member is a driven block rotatably connected to the drainage valve, and the driven block is provided with a first joint part driven by the full-drainage switch and a second abutting part which is in abutting fit with the water blocking member.

Further, the driven block comprises a first driven block and a second driven block which are rotatably connected to the drainage valve, the first driven block is driven by the full-drainage switch, and the first driven block drives the second driven block so that the second driven block releases the position limitation of the water blocking member; a first driving part for driving the second driven block to rotate is fixed to a peripheral side wall of the first driven block, and one end of the first joint part is fixed to the peripheral side wall of the first driven block and is driven by the full-drainage switch; and a second joint part matched with the first driving part is fixed to a peripheral side wall of the second driven block, one end of the second abutting part is fixed to the peripheral side wall of the second driven block, and the other end abuts against an upper end surface of the water blocking member.

Further, the water blocking member slides or swings relative to the water tank body, a partition board is arranged between the first water storage chamber and the second water storage chamber to separate the first water storage chamber and the second water storage chamber, and the water passage is a through hole formed in the partition board to connect the first water storage chamber with the second water storage chamber; and a side wall of the water blocking member abuts against a side wall of the partition board and moves up and down along the side wall of the partition board.

Further, a negative pressure generating device is further arranged in the second water storage chamber, the negative pressure generating device comprises a gas storage hood and a ventilation channel, and a gas storage space is formed at a top of the gas storage hood; one end of the ventilation channel is connected with the gas storage space, and the other end leads to a cavity of a toilet sewage pipe; and when the second drainage channel drains water, water in the gas storage hood is discharged to allow a negative pressure to be formed in the gas storage space, and then gas in the toilet sewage pipe is sucked through the ventilation channel.

Further, the water tank drainage volume control structure also comprises a water inlet device for filling the first water storage chamber and the second water storage chamber with water, and the water inlet device is arranged in the first water storage chamber or the second water storage chamber; or the water tank body is arranged in an external water tank, and the water inlet device is arranged in the external water tank and located outside the water tank body.

A toilet comprises a toilet body, and further comprises the water tank drainage volume control structure as described above.

Beneficial Effects

1. By arranging the water tank body, the drainage valve and the water blocking member, dividing an inner cavity of the water tank body into the first water storage chamber and the second water storage chamber, using the drainage valve to control the drainage of the second water storage chamber and the water blocking member to control the drainage of the first water storage chamber, and allowing the water blocking member to move relative to the water tank body under the control of the full-drainage switch or the half-drainage switch of the drainage valve to control switching of the first drainage channel between open and closed states, drainage control is realized by a single-drainage valve, and single drainage (only the second water storage chamber drains water) and dual drainage (full drainage, both the first water storage chamber and the second water storage chamber drain water) of the water tank can be realized. The structure is simple, and functions are reliable.

2. The first drainage channel is a water passage connecting the first water storage chamber with the second water storage chamber, and water in the first water storage chamber flows into the second water storage chamber via the water passage and then is discharged from the water tank body, which simplifies the structure of the water tank.

3. The full-drainage switch drives the water blocking member, so that the water blocking member is switched from controlling the water passage to be closed to controlling the water passage to be open, and the half-drainage switch does not drive the water blocking member; or, the half-drainage switch drives the water blocking member, so that the water blocking member is switched from controlling the water passage to be open to controlling the water passage to be closed, and the full-drainage switch does not drive the water blocking member. In this way, the water blocking member is directly driven by the full-drainage switch or the half-drainage switch, so that the control is more reliable and the structure is simple.

4. The valve core is linked with the water blocking member to allow the water blocking member to control switching of the water passage between open and closed states. In this way, the water blocking member can switch states along with the movement of the valve core, and the water blocking member can keep the water passage open when the valve core keeps the drainage port of the drainage valve open, so there is no need to set up another mechanism to allow the water blocking member to keep the water passage open for a period of time; and the water blocking member is reset after the valve core is reset, so that the driving and resetting control of the water blocking member is easier and more reliable.

5. The limiting member is provided for limiting the position of the water blocking member or releasing the position limitation of the water blocking member; and the full-drainage switch or the half-drainage switch is linked with the limiting member to release the position limitation of the water blocking member, so that the water blocking member controls switching of the water passage between open and closed states. In this way, the full-drainage switch or the half-drainage switch is not directly linked with the water blocking member, so that the driving force value of the full-drainage switch or the half-drainage switch is small. The design concept is ingenious.

6. The water blocking member comprises a buoyancy piece, a magnetic piece or an elastic piece, and after the position limitation of the water blocking member is released by the limiting member, the water blocking member moves relative to the water tank body under the action of buoyancy, magnetism or elasticity and opens the water passage. The structure for controlling the water blocking member to move relative to the water tank body is simple, and the functions are reliable.

7. By arranging the negative pressure generating device, when the drainage valve is opened to drain water, the water level in the gas storage hood is reduced, and a negative pressure is formed in the gas storage space at the top of the gas storage hood, so that air in the toilet sewage pipe can be sucked through the ventilation channel, which can promote the formation of a siphon effect in the toilet sewage pipe, so as to flush the toilet more completely.

BRIEF DESCRIPTION OF THE SEVERAL VIEWS OF THE DRAWINGS

The drawings described herein are used to provide a further understanding of the utility model and constitute a part of the utility model. The illustrative embodiments and descriptions of the utility model are used to explain the utility model, and do not constitute an improper limitation of the utility model.

Here.

DESCRIPTION OF REFERENCE NUMERALS

Figure 1:
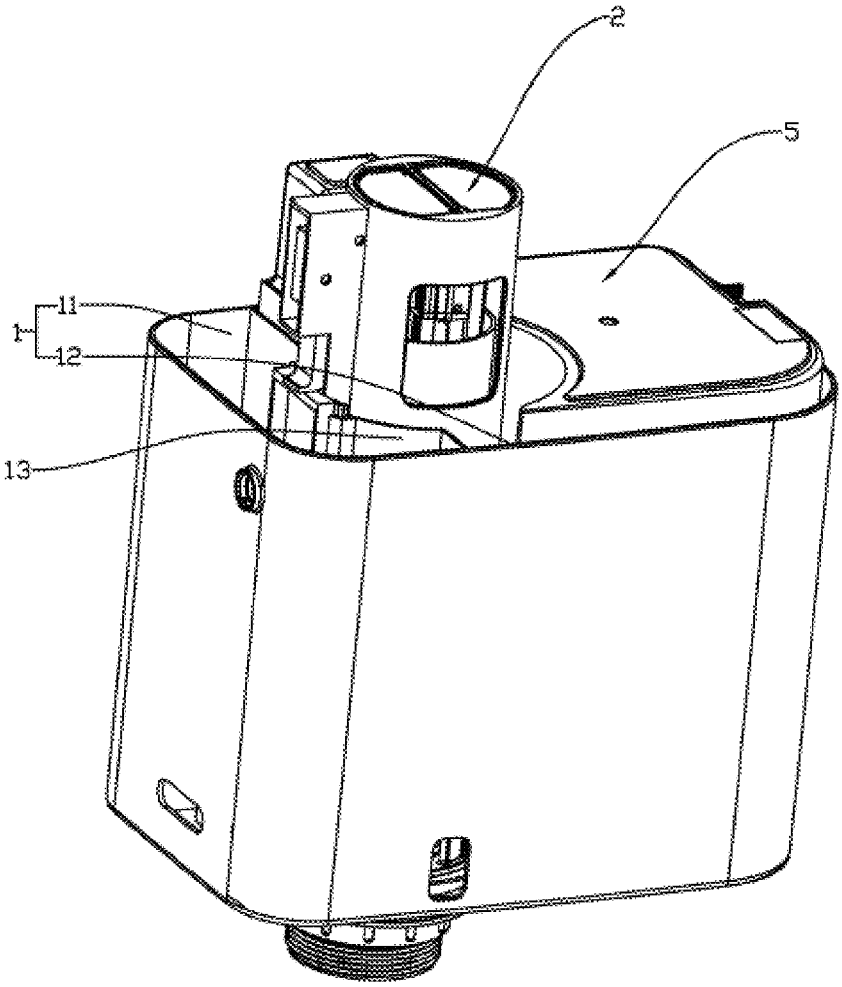
FIG. 1 is a diagram of an overall structure of the utility model.
Figure 2:
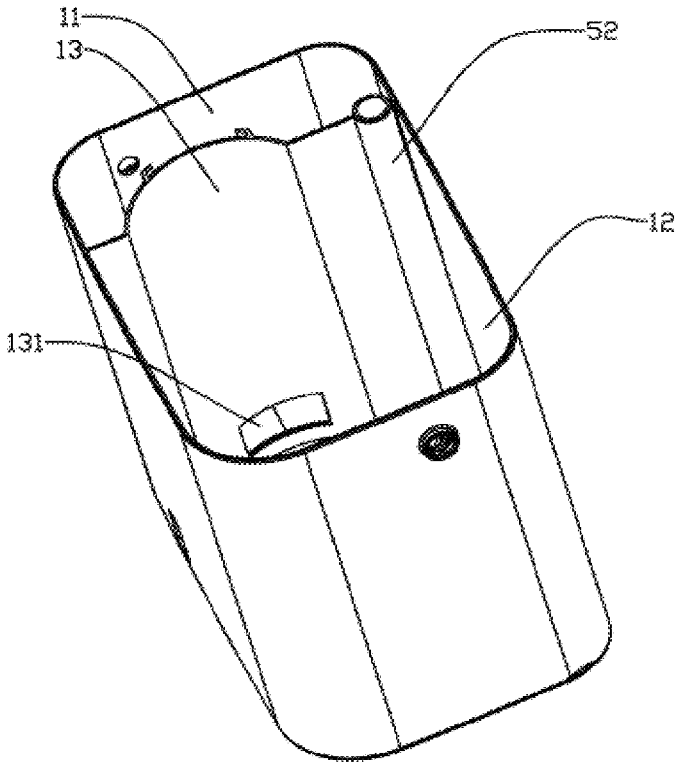
FIG. 2 is a diagram of an internal structure of a water tank body in the utility model.
Figure 3:
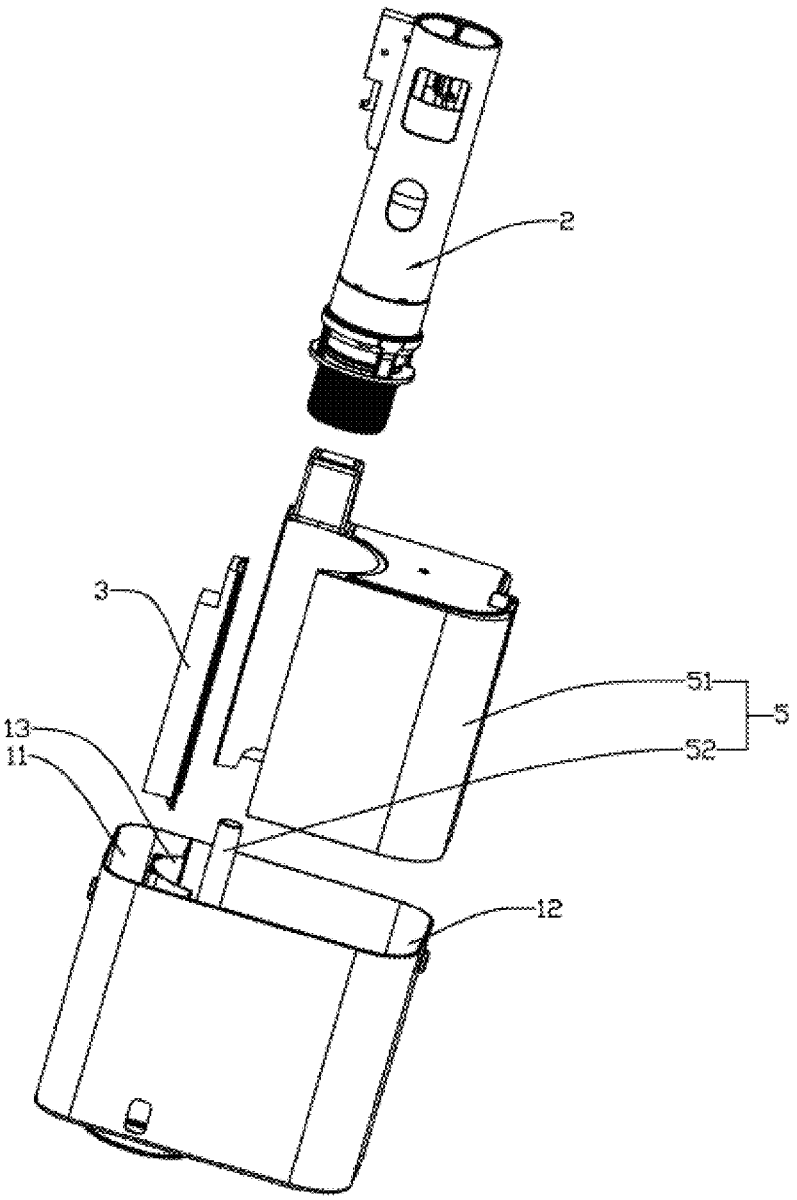
FIG. 3 is an exploded view of an overall structure of the utility model.
Figure 4:
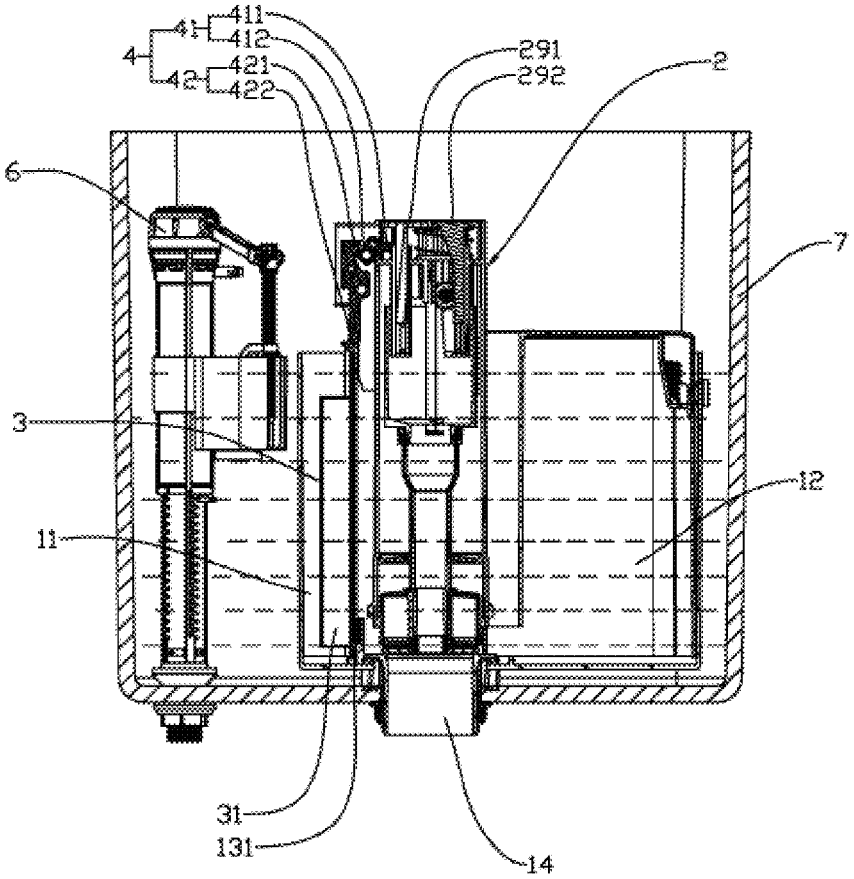
FIG. 4 is a sectional view of an overall structure of the utility model in an undrained state.

1. water tank body; 11. first water storage chamber; 12. second water storage chamber; 13. partition board; 131. water passage; 14. drainage port; 2. drainage valve; 21. body; 22. valve core; 23. separator; 24. float; 25. bottom cover of float; 26. base; 27. water stop pad part; 28. rack; 29. switch group; 291. full-drainage switch; 292. half-drainage switch; 210. gear; 3. water blocking member; 31. buoyancy chamber; 4. limiting member; 41. first driven block; 411. first joint part; 412. first driving part; 42. second driven block; 421. second joint part; 422. second abutting part; 5. negative pressure generating device; 51. gas storage hood; 511. gas storage space; 52. ventilation channel; 6. water inlet device; 7. external water tank.

DETAILED DESCRIPTION OF THE INVENTION

In order to make the technical problems to be solved by the utility model and the technical solutions and beneficial effects of the utility model clearer, the utility model will be further described in detail with reference to the drawings and embodiments. It should be understood that the specific embodiments described herein are only for the purpose of explaining the utility model and are not intended to limit the utility model.

Referring to FIGS. 1-4, the utility model discloses a water tank drainage volume control structure, which comprises a water tank body 1, a drainage valve 2, a water blocking member 3 and a limiting member 4.

The water tank body 1 has a first water storage chamber 11 and a second water storage chamber 12, the first water storage chamber 11 is provided with a first drainage channel, and the second water storage chamber 12 is provided with a second drainage channel. The drainage valve 2 is used for controlling the opening/closing of the second drainage channel.

The drainage valve 2 has a full-drainage switch 291 and a half-drainage switch 292 for controlling the opening of the second drainage channel.

The water blocking member 3 moves relative to the water tank body 1 under the control of the full-drainage switch 291 or the half-drainage switch 292, so as to control switching of the first drainage channel between open and closed states. When the water blocking member 3 controls the first drainage channel to be open under the control of the full-drainage switch 291 or the half-drainage switch 292, water in the first water storage chamber 11 and water in the second water storage chamber 12 are discharged, thus realizing the full drainage of the water tank; and when the water blocking member 3 controls the first drainage channel to be closed under the control of the full-drainage switch 291 or the half-drainage switch 292, water in the first water storage chamber 11 is not discharged, and water in the second water storage chamber 12 is discharged, thus realizing the half drainage of the water tank. In this way, both single drainage and dual drainage of the water tank are realized by a single-drainage valve, the structure is simple, and functions are reliable.

Specifically, in this embodiment, the first drainage channel is a water passage 131 connecting the first water storage chamber 11 with the second water storage chamber 12, and the first drainage channel is a drainage port 14 formed in the bottom of the second water storage chamber 12. When the water passage 131 is open, water from the first water storage chamber 11 flows to the second water storage chamber 12 via the water passage 131, and then is discharged out of the water tank body 1 through the second drainage channel (the drainage port 14), which features a simpler structure. In other embodiments, water in the first water storage chamber 11 and water in the second water storage chamber 12 may flow out of the water tank body 1 independently via the first drainage channel and the second drainage channel respectively, that is, during draining, water in the first water storage chamber 11 is directly discharged out of the water tank body 1 without flowing into the second water storage chamber 12 first.

Specifically, in this embodiment, a partition board 13 is arranged between the first water storage chamber 11 and the second water storage chamber 12 to separate the first water storage chamber 11 and the second water storage chamber 12, the water passage 131 is a through hole formed in the partition board 13 to connect the first water storage chamber 11 with the second water storage chamber 12, and the through hole is located at a bottom of the partition board 13.

Figure 5:
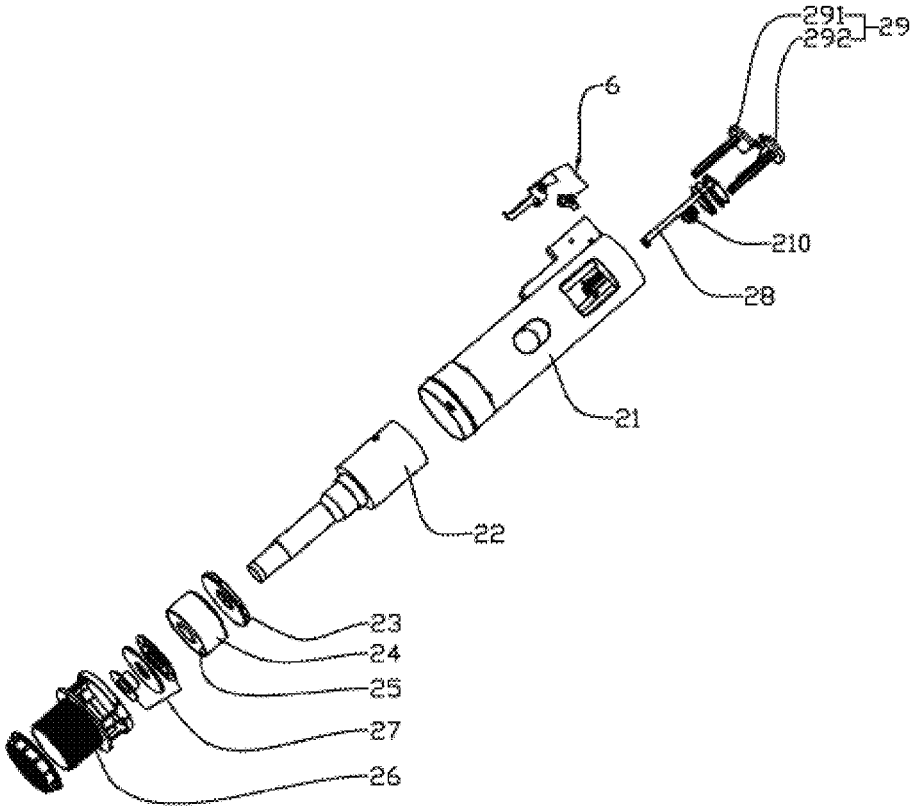
FIG. 5 is an exploded view of a drainage valve in the utility model.
Figure 6:
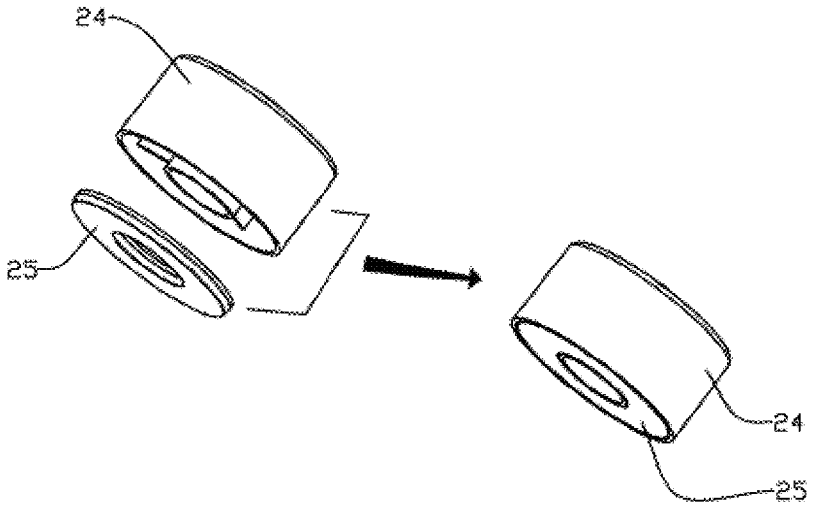
FIG. 6 is a diagram showing a connection relationship between a float and a bottom cover of the float in the utility model.
Figure 8:
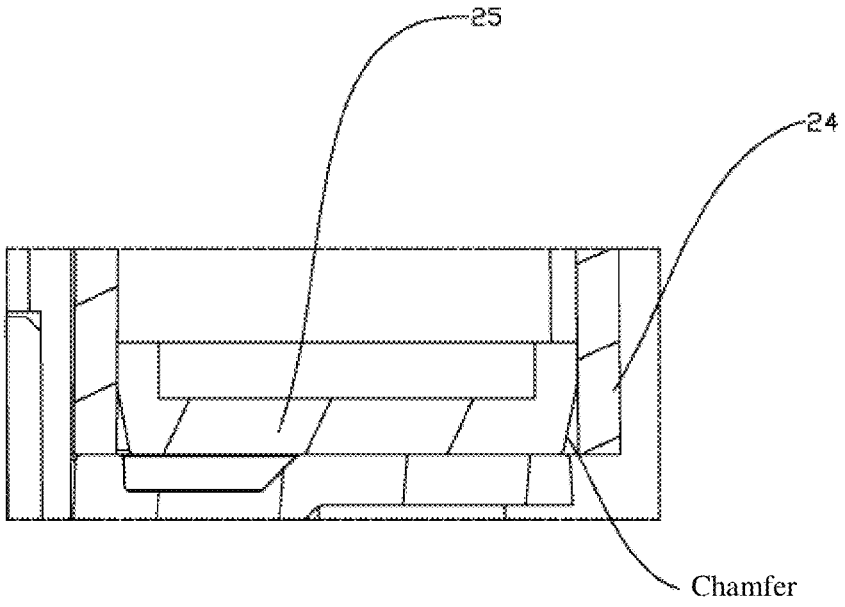
FIG. 8 is an enlarged view of part A in FIG. 7.

With reference to FIGS. 5, 6 and 8, the drainage valve 2 is used for controlling the opening/closing of the drainage port 14, and the drainage valve 2 comprises a hollow body 21, a valve core 22 slidably connected to the interior of the body 21 in a length direction of the body 21, a separator 23 fixed in the body 21, a float 24 arranged in the body 21 below the separator 23, a bottom cover of the float 25 fixed to a lower end of the float 24 in a sealed manner, a base 26 fixed at the drainage port 14 of the water tank body 1, a water stop pad part 27 fixed at a bottom end of the valve core 22 and in sealing fit and separation fit with the drainage port 14, a rack 28 for driving the valve core 22 to slide in the length direction of the body 21, a gear 210 meshed with the rack 28, and a switch group 29 for driving the gear 210 to rotate. The switch group 29 comprises a full-drainage switch 291 and a half-drainage switch 292 for driving the gear 210 to rotate, and the full-drainage switch 291 and the half-drainage switch 292 adopt key structures. A bottom of the bottom cover of the float 25 is chamfered, so that more glue can be used when the bottom cover 25 is fixed to a bottom opening of the float 24, so as to improve the bonding effect.

The full-drainage switch 291 and the half-drainage switch 292 drive the gear 210 to rotate so as to drive the rack 28 to move, the rack 28 further drives the valve core 22 to move, and the valve core 22 further drives the water stop pad part 27 to move upward and open the drainage port 14 for drainage. After moving up, the valve core 22 is coupled to the float 24 in a floating state. When the water level of the second water storage chamber 12 falls to a predetermined position, the float 24 falls due to the lack of buoyancy, and the valve core 22 falls with the float, driving the water stop pad part 27 to close the drainage port 14 again. The bottom cover of the float 25 is bonded to the bottom opening of the float 24 in a sealed manner, so as to prevent the float 24 from being immersed in water for a long time to cause water to enter a buoyancy chamber 31 in the float 24, making the buoyancy of the float 24 become smaller or even disappear and then leading to unstable drainage or even failures of the drainage valve.

In this embodiment, the limiting member 4 is used for limiting a position of the water blocking member 3 or releasing the position limitation of the water blocking member 3; and when the full-drainage switch 291 is driven, the full-drainage switch 291 is linked with the limiting member 4 to release the position limitation of the water blocking member 3, and the water blocking member 3 moves relative to the water tank body 1 and controls the water passage 131 to switch to an open state.

Specifically, in this embodiment, the water blocking member 3 is preferably arranged in a sliding manner relative to the water tank body 1, and a side wall of the water blocking member 3 abuts against a side wall of the partition board 13 and slides up and down along the side wall of the partition board 13 to control switching of the water passage 131 between open and closed states. The water blocking member 3 comprises a buoyancy piece, a magnetic piece or an elastic piece; after the position limitation of the water blocking member 3 is released by the limiting member 4, the water blocking member 3 slides relative to the water tank body 1 under the action of buoyancy, magnetism or elasticity and opens the water passage 131; and the water blocking member 3 returns to the original position and closes the water passage 131 under the action of its own gravity or under the linkage of the valve core 22 of the drainage valve 2.

In this embodiment, the water blocking member 3 preferably comprises a buoyancy piece, and a buoyancy chamber 31 is arranged in the buoyancy piece. After the position limitation of the water blocking member 3 is released by the limiting member 4, the water blocking member 3 floats up under the buoyancy of the buoyancy chamber 31, so that the operation of the full-drainage switch 291 of the drainage valve is easier. In other embodiments, the water blocking member 3 may swing relative to the water tank body 1.

Specifically, the limiting member 4 is a driven block rotatably connected to the drainage valve 2 the driven block is provided with a first joint part 411 driven by the full-drainage switch 291 and a second abutting part 422 which is in abutting fit with the water blocking member 3. More specifically, the driven block comprises a first driven block 41 and a second driven block 42 which are rotatably connected to the drainage valve 2. The first driven block 41 is driven by the full-drainage switch 291, and the first driven block 41 drives the second driven block 42 so that the second driven block 42 releases the position limitation of the water blocking member 3.

A first joint part 411 driven by the full-drainage switch 291 and a first driving part 412 for driving the second driven block 42 to rotate are fixed to a peripheral side wall of the first driven block 41.

A second joint part 421 cooperating with the first driving part 412 and a second abutting part 422 abutting against an upper end face of the water blocking member 3 are fixed to a peripheral side wall of the second driven block 42.

Figure 7:
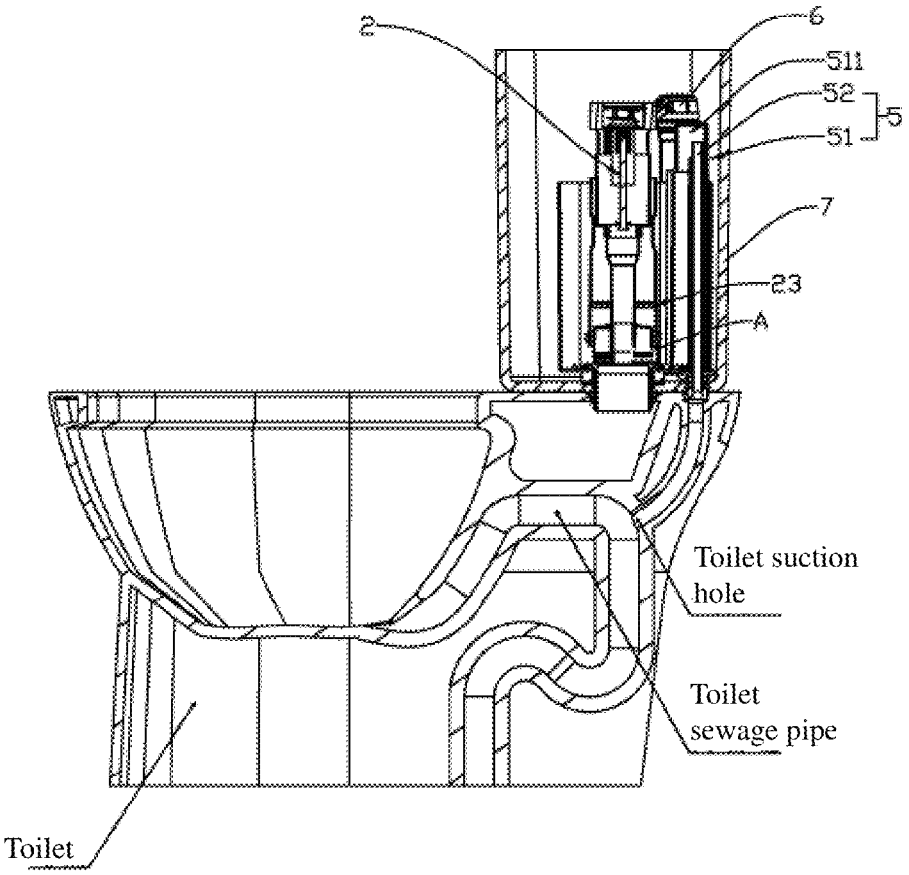
FIG. 7 is a connection diagram of a negative pressure generating device in the utility model.

With reference to FIG. 7, a negative pressure generating device 5 is further arranged in the second water storage chamber 12, the negative pressure generating device 5 comprises a gas storage hood 51 and a ventilation channel 52, and a gas storage space 511 is formed at a top of the gas storage hood 51; and one end of the ventilation channel 52 is connected with the gas storage space 511, and the other end leads to a cavity of a toilet sewage pipe which is provided with two water traps (not shown). A side wall of the toilet sewage pipe between the two water traps is provided with a toilet suction hole. The ventilation channel 52 communicates with the cavity of the toilet sewage pipe through the toilet suction hole. When the second drainage channel (drainage port 14) drains water, water in the gas storage hood 51 is discharged to allow a negative pressure to be formed in the gas storage space 511, and then gas in the toilet sewage pipe is sucked through the ventilation channel 52, which can promote the formation of a siphon effect in the toilet sewage pipe, so as to flush the toilet more completely.

A water inlet device 6 is also arranged in the water tank body 1, which is used for filling the first water storage chamber 11 and the second water storage chamber 12 with water, and the water inlet device 6 may be a mechanical ball valve or an electromagnetic valve. In this embodiment, the water tank body 1 is placed in an external water tank 7, the water inlet device 6 is arranged in the external water tank 7 and located outside the water tank body 1, and the first water storage chamber 11 and the second water storage chamber 12 are filled with water through communication channels. In other embodiments, the water inlet device 6 can (but not limited to) be arranged in the first water storage chamber 11 or the second water storage chamber 12.

The water tank drainage volume control structure can be used on a toilet, so that the toilet has all the functions of the water tank drainage volume control structure.

The operation steps of this embodiment are as follows.

Figure 9:
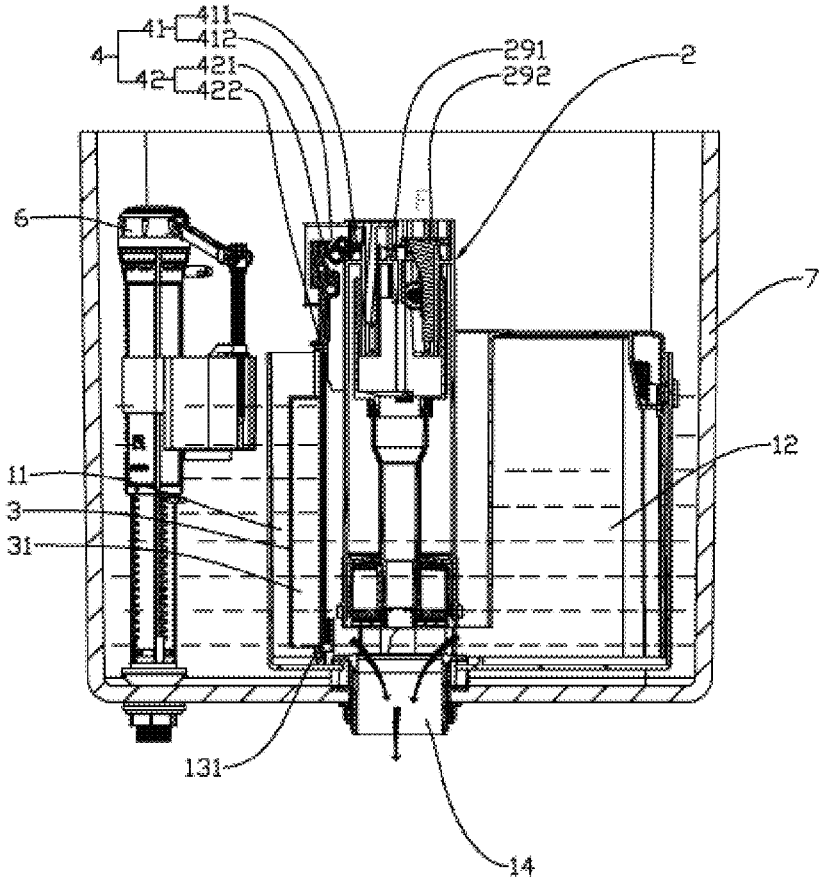
FIG. 9 is a sectional view of an overall structure of the utility model in a half-drained state.

Referring to FIG. 9, to flush urine, the half-drainage switch 292 is pushed down to drive the drainage valve 2 to start and drain the second water storage chamber 12; at this point, a negative pressure is formed at the top of the gas storage hood 51 of the negative pressure generating device 5 in the second water storage chamber 12 due to a water level drop, and air in the toilet sewage pipe will be sucked through the ventilation channel 52, which can promote the formation of a siphon effect in the toilet sewage pipe, so as to flush the toilet more completely; and because the half-drainage switch 292 is not linked with the limiting member 4, the limiting member 4 keeps limiting the position of the water blocking member 3, so that the water blocking member 3 keeps closing the water passage 131 and water in the first water storage chamber 11 is not discharged, thereby realizing single drainage.

Figure 10:
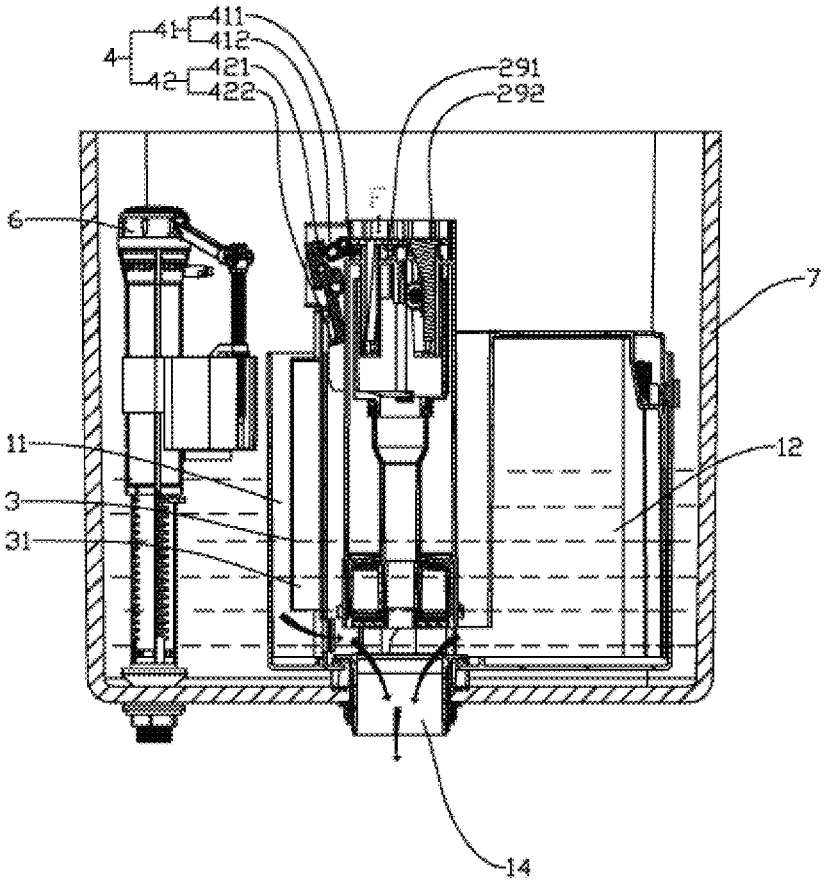
FIG. 10 is a sectional view of an overall structure of the utility model in a dual-drained (full-drained) state.

Referring to FIG. 10, to flush feces, the full-drainage switch 291 is pushed down to drive the drainage valve 2 to start, and at the same time, the full-drainage switch 291 drives the first driven block 41 and the second driven block 42 of the limiting member 4 to act, thereby releasing the position limitation of the water blocking member 3, and the water blocking member 3 moves up along the side wall of the partition board 13 due to buoyancy, so that the water passage 131 between the first water storage chamber 11 and the second water storage chamber 12 is open; as a result, the first water storage chamber 11 and the second water storage chamber 12 drain water at the same time, which increases the amount of flushing water and the flushing intensity; and during flushing, a negative pressure is formed at the top of the gas storage hood 51 of the negative pressure generating device 5 in the second water storage chamber 12 due to a water level drop, and air in the toilet sewage pipe will be sucked through the ventilation channel 52, which can promote the formation of a siphon effect in the toilet sewage pipe, so as to flush the toilet more completely.

In other embodiments which are not shown, the full-drainage switch 291 may not be linked with the limiting member 4, but the half-drainage switch 292 is linked with the limiting member 4. Specifically, when the full-drainage switch 291 is driven, the water passage 131 is kept in an open state, and when the half-drainage switch 292 is driven, the half-drainage switch 292 is linked with the limiting member 4 to release the position limitation of the water blocking member 3, so that the water blocking member 3 moves relative to the water tank body 1 and controls the water passage 131 to switch to a closed state, which is also feasible.

In other embodiments which are not shown, the limiting member 4 may not be provided, and the full-drainage switch 291 directly drives the water blocking member 3 or the half-drainage switch 292 directly drives the water blocking member 3. Specifically, the full-drainage switch 291 drives the water blocking member 3, so that the water blocking member 3 controls the water passage 131 to switch to an open state from a closed state, and the half-drainage switch 292 does not drive the water blocking member 3; alternatively, the half-drainage switch 292 drives the water blocking member 3, so that the water blocking member 3 controls the water passage 131 to switch to a closed state from an open state, and the full-drainage switch 291 does not drive the water blocking member 3. Preferably, the drainage valve comprises a valve core 22 which is in opening/closing fit with the drainage port 14, and a float component in coupling fit or separation fit with the valve core 22. The valve core 22 is coupled to the float component after being driven to rise by the full-drainage switch 291 and the half-drainage switch 292, and the valve core 22 is linked with the water blocking member 3 so that the water blocking member 3 can control switching of the water passage 131 between open and closed states. Specifically, when the full-drainage switch 291 is used for driving the water blocking member 3, the full-drainage switch 291 is pressed to drive the valve core 22 to move upward, and the valve core 22 further drives the water stop pad part 27 to open the drainage port 14 for drainage, and at the same time, the valve core 22 drives the water blocking member 3 to control the water passage 131 to be open, so as to realize full drainage. When the half-drainage switch 292 is used for driving the water blocking member 3, the half-drainage switch 292 is pressed to drive the valve core 22 to move upward, and the valve core 22 further drives the water stop pad part 27 to open the drainage port 14 for drainage, and at the same time, the valve core 22 drives the water blocking member 3 to control the water passage 131 to be closed, so as to realize half drainage.

The utility model has been described in an exemplary way with the attached drawings. Obviously, the specific implementation of the utility model is not limited by the above-mentioned way, and various immaterial improvements made by adopting the method idea and technical scheme of the utility model, or direct applications of the idea and technical scheme of the utility model to other occasions without improvement are within the protection scope of the utility model.

What is claimed is:

1. A water tank drainage volume control structure, comprising: a water tank body (1), having a first water storage chamber (11) and a second water storage chamber (12), the first water storage chamber (11) being provided with a first drainage channel, and the second water storage chamber (12) being provided with a second drainage channel; a drainage valve (2), used for controlling the opening/closing of the second drainage channel, the drainage valve (2) being provided with a full-drainage switch (291) and a half-drainage switch (292) for controlling the opening of the second drainage channel; and a water blocking member (3), moving with respect to the water tank body (1) under the control of the full-drainage switch (291) or the half-drainage switch (292) so as to control switching of the first drainage channel between open and closed states.

2. The water tank drainage volume control structure according to claim 1, wherein the first drainage channel is a water passage (131) connecting the first water storage chamber (11) with the second water storage chamber (12), and when the water passage (131) is open, water in the first water storage chamber (11) flows to the second water storage chamber (12) via the water passage (131); or, water in the first water storage chamber (11) and water in the second water storage chamber (12) flow out of the water tank body independently through the first drainage channel and the second drainage channel respectively, and the second drainage channel is a drainage port (14) formed in a bottom of the second water storage chamber (12).

3. The water tank drainage volume control structure according to claim 2, wherein the full-drainage switch (291) drives the water blocking member (3), so that the water blocking member (3) is switched from controlling the water passage (131) to be closed to controlling the water passage (131) to be open, and the half-drainage switch (292) does not drive the water blocking member (3); or, the half-drainage switch (292) drives the water blocking member (3), so that the water blocking member (3) is switched from controlling the water passage (131) to be open to controlling the water passage (131) to be closed, and the full-drainage switch (291) does not drive the water blocking member (3).

4. The water tank drainage volume control structure according to claim 3, wherein the drainage valve comprises a valve core (22) in open-close fit with the drainage port (14), and a float component in coupling fit or separation fit with the valve core (22), the valve core (22) is driven to ascend by the full-drainage switch (291) and the half-drainage switch (292) and then is coupled to the float component, and the valve core (22) is linked with the water blocking member (3) so that the water blocking member (3) can control switching of the water passage (131) between open and closed states.

5. The water tank drainage volume control structure according to claim 2, further comprising a limiting member (4) for limiting a position of the water blocking member (3) or releasing the position limitation of the water blocking member (3); when the full-drainage switch (291) is driven, the full-drainage switch (291) is linked with the limiting member (4) to release the position limitation of the water blocking member (3), and the water blocking member (3) moves relative to the water tank body (1) and controls the water passage (131) to switch to an open state; or, when the half-drainage switch (291) is driven, the position limitation of the water blocking member (3) is released by the limiting member (4), and the water blocking member (3) moves relative to the water tank body (1) and controls the water passage (131) to switch to a closed state.

6. The water tank drainage volume control structure according to claim 5, wherein the water blocking member (3) comprises a buoyancy piece, a magnetic piece or an elastic piece; after the position limitation of the water blocking member (3) is released by the limiting member (4), the water blocking member (3) moves relative to the water tank body (1) under the action of buoyancy, magnetism or elasticity and opens the water passage (131); and the water blocking member (3) returns to the original position and closes the water passage (131) under the action of its own gravity or under the linkage of the valve core (22) of the drainage valve (2).

7. The water tank drainage volume control structure according to claim 5, wherein the limiting member (4) is a driven block rotatably connected to the drainage valve (2), and the driven block is provided with a first joint part (411) driven by the full-drainage switch (291) and a second abutting part (422) which is in abutting fit with the water blocking member (3).

8. The water tank drainage volume control structure according to claim 7, wherein the driven block comprises a first driven block (41) and a second driven block (42) which are rotatably connected to the drainage valve (2), the first driven block (41) is driven by the full-drainage switch (291), and the first driven block (41) drives the second driven block (42) so that the second driven block (42) releases the position limitation of the water blocking member (3); a first driving part (412) for driving the second driven block (42) to rotate is fixed to a peripheral side wall of the first driven block (41), and one end of the first joint part (411) is fixed to the peripheral side wall of the first driven block (41) and is driven by the full-drainage switch (291); and a second joint part (421) matched with the first driving part (412) is fixed to a peripheral side wall of the second driven block (42), one end of the second abutting part (422) is fixed to the peripheral side wall of the second driven block (42), and the other end abuts against an upper end surface of the water blocking member (3).

9. The water tank drainage volume control structure according to claim 2, wherein the water blocking member (3) slides or swings relative to the water tank body (1), a partition board (13) is arranged between the first water storage chamber (11) and the second water storage chamber (12) to separate the first water storage chamber (11) and the second water storage chamber (12), and the water passage (131) is a through hole formed in the partition board (13) to connect the first water storage chamber (11) with the second water storage chamber (12); and a side wall of the water blocking member (3) abuts against a side wall of the partition board (13) and moves up and down along the side wall of the partition board (13).

10. The water tank drainage volume control structure according to claim 1, wherein a negative pressure generating device (5) is further arranged in the second water storage chamber (12), the negative pressure generating device (5) comprises a gas storage hood (51) and a ventilation channel (52), and a gas storage space (511) is formed at a top of the gas storage hood (51); one end of the ventilation channel (52) is connected with the gas storage space (511), and the other end leads to a cavity of a toilet sewage pipe; and when the second drainage channel drains water, water in the gas storage hood (51) is discharged to allow a negative pressure to be formed in the gas storage space (511), and then gas in the toilet sewage pipe is sucked through the ventilation channel (52).

11. The water tank drainage volume control structure according to claim 1, further comprising a water inlet device (6) for filling the first water storage chamber (11) and the second water storage chamber (12) with water, and the water inlet device (6) is arranged in the first water storage chamber (11) or the second water storage chamber (12); or the water tank body (1) is arranged in an external water tank (7), and the water inlet device (6) is arranged in the external water tank (7) and located outside the water tank body (1).

12. A toilet, comprising a toilet body, and further comprising the water tank drainage volume control structure according to claim 1.

13. A toilet, comprising a toilet body, and further comprising the water tank drainage volume control structure according to claim 1, wherein the first drainage channel is a water passage (131) connecting the first water storage chamber (11) with the second water storage chamber (12), and when the water passage (131) is open, water in the first water storage chamber (11) flows to the second water storage chamber (12) via the water passage (131); or, water in the first water storage chamber (11) and water in the second water storage chamber (12) flow out of the water tank body independently through the first drainage channel and the second drainage channel respectively, and the second drainage channel is a drainage port (14) formed in a bottom of the second water storage chamber (12).

14. A toilet, comprising a toilet body, and further comprising the water tank drainage volume control structure according to claim 2, wherein the full-drainage switch (291) drives the water blocking member (3), so that the water blocking member (3) is switched from controlling the water passage (131) to be closed to controlling the water passage (131) to be open, and the half-drainage switch (292) does not drive the water blocking member (3); or, the half-drainage switch (292) drives the water blocking member (3), so that the water blocking member (3) is switched from controlling the water passage (131) to be open to controlling the water passage (131) to be closed, and the full-drainage switch (291) does not drive the water blocking member (3).

15. A toilet, comprising a toilet body, and further comprising the water tank drainage volume control structure according to claim 3, wherein the drainage valve comprises a valve core (22) in open-close fit with the drainage port (14), and a float component in coupling fit or separation fit with the valve core (22), the valve core (22) is driven to ascend by the full-drainage switch (291) and the half-drainage switch (292) and then is coupled to the float component, and the valve core (22) is linked with the water blocking member (3) so that the water blocking member (3) can control switching of the water passage (131) between open and closed states.

16. A toilet, comprising a toilet body, and further comprising the water tank drainage volume control structure according to claim 2, further comprising a limiting member (4) for limiting a position of the water blocking member (3) or releasing the position limitation of the water blocking member (3); when the full-drainage switch (291) is driven, the full-drainage switch (291) is linked with the limiting member (4) to release the position limitation of the water blocking member (3), and the water blocking member (3) moves relative to the water tank body (1) and controls the water passage (131) to switch to an open state; or, when the half-drainage switch (291) is driven, the position limitation of the water blocking member (3) is released by the limiting member (4), and the water blocking member (3) moves relative to the water tank body (1) and controls the water passage (131) to switch to a closed state.

17. A toilet, comprising a toilet body, and further comprising the water tank drainage volume control structure according to claim 5, wherein the water blocking member (3) comprises a buoyancy piece, a magnetic piece or an elastic piece; after the position limitation of the water blocking member (3) is released by the limiting member (4), the water blocking member (3) moves relative to the water tank body (1) under the action of buoyancy, magnetism or elasticity and opens the water passage (131); and the water blocking member (3) returns to the original position and closes the water passage (131) under the action of its own gravity or under the linkage of the valve core (22) of the drainage valve (2).

18. A toilet, comprising a toilet body, and further comprising the water tank drainage volume control structure according to claim 5, wherein the limiting member (4) is a driven block rotatably connected to the drainage valve (2), and the driven block is provided with a first joint part (411) driven by the full-drainage switch (291) and a second abutting part (422) which is in abutting fit with the water blocking member (3).

19. A toilet, comprising a toilet body, and further comprising the water tank drainage volume control structure according to claim 2, wherein the water blocking member (3) slides or swings relative to the water tank body (1), a partition board (13) is arranged between the first water storage chamber (11) and the second water storage chamber (12) to separate the first water storage chamber (11) and the second water storage chamber (12), and the water passage (131) is a through hole formed in the partition board (13) to connect the first water storage chamber (11) with the second water storage chamber (12); and a side wall of the water blocking member (3) abuts against a side wall of the partition board (13) and moves up and down along the side wall of the partition board (13).

20. A toilet, comprising a toilet body, and further comprising the water tank drainage volume control structure according to claim 1, wherein a negative pressure generating device (5) is further arranged in the second water storage chamber (12), the negative pressure generating device (5) comprises a gas storage hood (51) and a ventilation channel (52), and a gas storage space (511) is formed at a top of the gas storage hood (51); one end of the ventilation channel (52) is connected with the gas storage space (511), and the other end leads to a cavity of a toilet sewage pipe; and when the second drainage channel drains water, water in the gas storage hood (51) is discharged to allow a negative pressure to be formed in the gas storage space (511), and then gas in the toilet sewage pipe is sucked through the ventilation channel (52).

* * * * *